United States Patent [19]

Vermeulen et al.

[11] 3,955,785

[45] May 11, 1976

[54] ELECTRICAL PROTECTIVE CIRCUITS

[76] Inventors: Dirk J. Vermeulen, 86 Hamilton Ave., Craighall Park, Johannesburg, South Africa; Ernest J. Moorey, 148 Cleeve Drive, Ivy Bridge, Devon, England

[22] Filed: Oct. 7, 1974

[21] Appl. No.: 512,933

Related U.S. Application Data

[63] Continuation-in-part of Ser. No. 331,005, Feb. 9, 1973, abandoned.

[52] U.S. Cl. ..... 246/34 CT; 246/40

[51] Int. Cl.[2] ..... B61L 23/16

[58] Field of Search ..... 246/34 CT, 36, 40, 37, 246/131, 132, 134, 112, 113, 114 R, 114 A, 115

[56] References Cited

UNITED STATES PATENTS

| | | | |
|---|---|---|---|
| 2,993,116 | 7/1961 | Utt | 246/36 |
| 3,683,176 | 8/1972 | Crofts | 246/40 |

FOREIGN PATENTS OR APPLICATIONS

| | | | |
|---|---|---|---|
| 1,909,423 | 9/1970 | Germany | 246/40 |
| 1,185,636 | 2/1959 | France | 246/34 CT |

*Primary Examiner*—Trygve M. Blix
*Assistant Examiner*—Reinhard J. Eisenzopf
*Attorney, Agent, or Firm*—Berman, Aisenberg & Platt

[57] ABSTRACT

A detective circuit for railway points composed of three track sections connected together at a junction or for a railway crossing composed of four track sections connected together at a junction. The detective circuit comprises an ac generator adapted to supply energy at a selected frequency across the junction of the points or crossing, a first capacitor connected across the junction to form a resonant circuit at the aforementioned frequency with the inductance of the lengths of track between the junction and the intersection or intersections of the tracks, a low impedance, frequency selective link connected across the tracks of each section of the points or crossing, each link comprising a second capacitor forming a tuned circuit at the aforementioned frequency with the inductance of an inductor connected in series therewith, and a device for monitoring the current or voltage in each link, the current or voltage in each link in the converging track sections of the points or crossing appearing as result of the voltage arising in the aforementioned lengths of track during use of the detective circuit.

5 Claims, 1 Drawing Figure

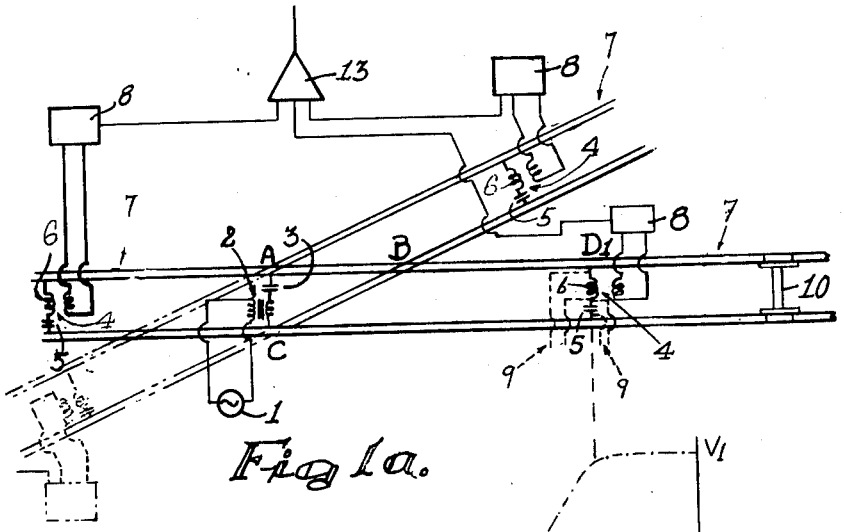
Fig 1a.
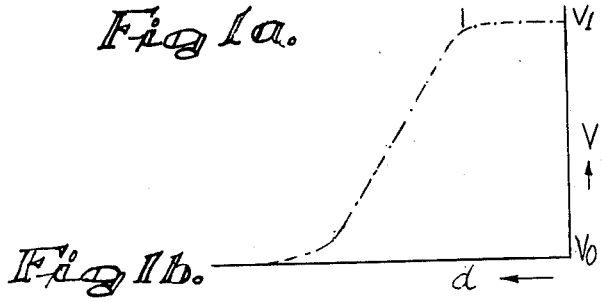
Fig 1b.
Fig 2.
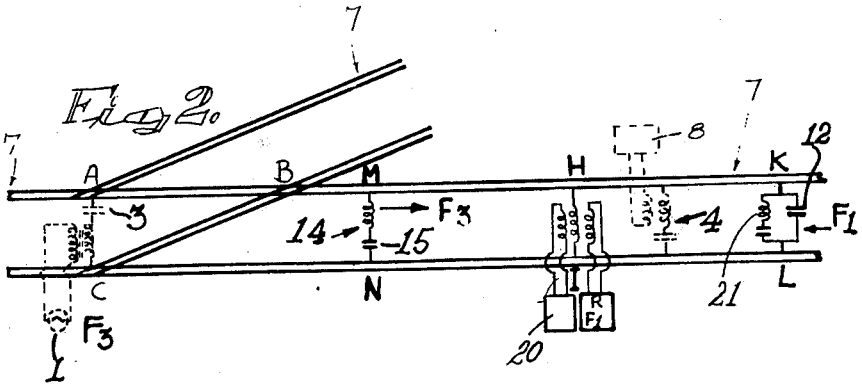

ELECTRICAL PROTECTIVE CIRCUITS

This application is a continuation-in-part of U.S. Application Ser. No. 331,005 filed Feb. 9th, 1973 now abandoned.

BACKGROUND OF THE INVENTION

This Invention relates to electrical detective circuits for railway points and crossings.

It has been proposed to provide an ac generator to supply energy across a points or crossings junction. A capacitor is connected across the junction to form a resonant circuit, at the generator frequency, with the inductance of the lengths of track between the junction and the intersection of the tracks.

The resultant voltage arising in these lengths of track is used to supply second circuits located in the converging entries of the points or crossing. Each second circuit comprises a short-circuit across the tracks and a second capacitor connected across the tracks at a position between the short-circuit and the points or crossing. The second capacitor forms a resonant circuit at the generator frequency with the inductance of the short-circuit and of the lengths of track between the short-circuit and the second capacitor.

The detective circuit described above does not require insulation blocks in the tracks as do conventional points and crossings track circuits.

When a train axle passes the short circuit the axle shunts the second circuit and its tuning is disturbed. This provides a means of detecting the presence of the axle.

The circuit described above suffers from the disadvantage that it cannot be overlapped with a jointless track circuit such as the "Aster" track circuit. The reason for this is that the short-circuit described above will impose a non-detective zone between the points or crossing circuit and the jointless track circuit.

BRIEF SUMMARY OF THE INVENTION

It is an object of the present invention to provide a detective circuit of the above kind which can be overlapped with other suitable jointless track circuits.

According to this invention there is provided a detective circuit for railway points composed of three track sections connected together at a junction or for a railway crossing composed of four track sections connected together at a junction, said circuit comprising:

an ac generator adapted to supply energy at a selected frequency across the junction of the points or crossing, a first capacitor connected across the junction to form a resonant circuit at the said frequency with the inductance of the lengths of track between the junction and the intersection or intersections of the tracks, a low impedance, frequency selective link connected across the tracks of each section of the points or crossing, each link comprising a second capacitor forming a tuned circuit at the said frequency with the inductance of an inductor connected in series therewith, and means for monitoring the current or voltage in each link, the current or voltage in each link in the converging track sections of the points or crossing appearing as a result of the voltage arising in the aforesaid lengths of track during use of the detective circuit.

Further features of the invention provide for the generator to be connected to a transformer of which a winding is connected across the junction, the first capacitor being connected in series with said winding, the first capacitor forming a resonant circuit with the inductance of the aforesaid lengths of track and of the winding, and or the said means to include conductors connected across each second capacitor or inductor or to be receivers inductively coupled one to each inductor and a device connected to each receiver, the device forming an AND gate.

The invention also provides for the link in one or more track sections of the points or crossing to be overlapped with a jointless track circuit adapted to monitor vehicle presence on the track leading to the relevant track section.

BRIEF DESCRIPTION OF THE DRAWINGS

FIG. 1*a* illustrates a detective circuit in accordance with the invention,

FIG. 1*b* is a voltage diagram, and

FIG. 2 illustrates the detective circuits of FIG. 1 overlapped with a jointless track circuit.

DETAILED DESCRIPTION OF PREFERRED EMBODIMENTS OF THE INVENTION

Referring to FIG. 1, there is shown a set of railway points composed of three track sections 7 connected together at a junction AC. An ac generator 1 is connected to the primary winding of a transformer 2 of which the secondary winding is connected across the junction AC.

A first capacitor 3 is connected in series with the secondary winding to form a resonant circuit, at the generator frequency, with the inductance of the lengths of track AB and CB between the junction and the intersection of the tracks and with the inductance of the secondary winding. The voltage arising in the lengths of track AB and CB is used to power detective circuits in the two converging sections of the points. The voltage developed across the junction AC is used directly to power the detective circuit in the remaining section of the points.

The detective circuits in the track sections comprise a low impedance, frequency selective link 4 across the tracks of each section. Each link comprises a second capacitor 5 forming a resonant circuit at the generator frequency with the inductance of an inductor 6 connected in series therewith.

Means are provided for monitoring the current in each link 4 comprising receivers 8, one inductively coupled to each inductor 6. Each receiver is connected to a receiving device 13 forming an AND gate. Should the signal from any one receiver 8 diminish by a predetermined amount, the output of the receiving device will consequently change or disappear and a suitable relay will be de-energised. In an alternative arrangement means may be provided for monitoring the voltage in each link 4 in the form of conductors 9 connected across the capacitor 5 or inductor 6 of the link as shown in dotted lines in FIG. 1a.

In use, the receiver voltage derived from each link 4 remains constant at a value of say VI. When a wheel axle 10 crosses a link 4, the axle shunts the resonant circuit formed by the capacitor 5 and the voltage VI drops to Vo as shown in FIG. 1*b*. Detection of a wheel axle can therefore take place in the relatively short length of track.

In FIG. 1 the detective circuit described above is shown overlapped with an "Aster" jointless track circuit. The latter is known in the art and will not be described in great detail. A capacitor 12 forms a resonant circuit, at a frequency F1 of a signal received along the track, with the inductance of an inductor HI and the inductance of the lengths of track HK and IL. A series tuned link 14 blocks transmission of signal F1 beyond that link.

When an axle shunts the resonant circuit described above it is detected by the resultant fall-off of voltage in a receiver RF1.

The detective circuit according to the invention, operating at a frequency F3, is shown in dotted lines in FIG. 2, the link 4 being located to the right of the inductor HI in the drawing. The frequencies F1 and F3 are chosen at sufficiently different values to allow the two detective circuits to operate reasonably unaffected by one another. It will readily be appreciated that the above arrangement has no non-detective zone and that an axle placed anywhere along the track section will be detected by either or both the detective circuits described above.

The Aster track circuit usually has a filter 21 and a generator 20 adapted to supply a signal F2 further down the track. No such filter and generator are required in the present embodiment and these may be utilised for other purposes.

It will be understood at the circuits described above may equally well be applied to railway crossings. Such circuits would be the same as those described above and would also be included in the fourth track section shown in chain-dotted lines in FIG. 1.

What we claim as new and desire to secure by Letters Patent is:

1. A detective circuit for railway points composed of three track sections connected together at a junction or for a railway crossing composed of four track sections connected together at a junction, said circuit comprising ac generator means for supplying energy at a selected frequency across the junction of the points or crossing, a first capacitor connected across the junction to form a resonant circuit at the said frequency with the inductance of the lengths of track between the junction and the intersection or intersections of the tracks, said tuned circuit comprising $C + L_{AB} + L_{BC}$, wherein C is the capacitance of said capacitor and $L_{AB}$ and $L_{BC}$ are the inductances of two of said lengths of track, a low impedance, frequency selective link connected across the tracks of each section of the points or crossing, each link comprising a second capacitor forming a tuned circuit at the said frequency with the inductance of an inductor connected in series therewith, and, means for monitoring the current or voltage in each link, the current or voltage in each link in the converging track sections of the points or crossing appearing as a result of the voltage arising in the aforesaid lengths of track during use of the detective circuit.

2. A circuit as claimed in claim 1 in which the generator is connected to a transformer of which a winding is connected across the junction, said first capacitor being connected in series with said winding, said first capacitor forming a resonant circuit with the inductance of the aforesaid lengths of track and of the winding.

3. A circuit as claimed in claim 1 in which the means for monitoring the current in each link comprise receivers inductively coupled one to each inductor and a device connected to each receiver, the device forming an AND gate.

4. A circuit as claimed in claim 1 in which the means for monitoring the voltage in each link include conductors connected across said second capacitor or inductor.

5. A circuit as claimed in claim 1 in which the link in one or more track sections of the points or crossing is overlapped with jointless track circuit means for monitoring vehicle presence on the track leading to the relevant track section.

* * * * *